US006484908B1

(12) United States Patent
Tsaur

(10) Patent No.: US 6,484,908 B1
(45) Date of Patent: Nov. 26, 2002

(54) PRESSURIZED PISTON PUSHER

(76) Inventor: Garry Tsaur, 19222 Tranbarger St., Rowland Heights, CA (US) 91748

( * ) Notice: Subject to any disclaimer, the term of this patent is extended or adjusted under 35 U.S.C. 154(b) by 0 days.

(21) Appl. No.: 10/103,611

(22) Filed: Mar. 21, 2002

(51) Int. Cl.[7] ..... B67D 5/42; C01F 11/00

(52) U.S. Cl. ..... 222/389; 222/541.6; 222/374; 206/469

(58) Field of Search ..... 222/389, 394, 222/541.6, 399, 61, 541.2, 541.3, 541.4; 206/469, 219; 277/604, 448

(56) References Cited

U.S. PATENT DOCUMENTS 3,380,383 A * 4/1968 Schnepfe, Jr. ..... 102/368
3,404,810 A * 10/1968 Bers ..... 102/482
3,437,245 A * 4/1969 Hebert et al. ..... 102/482
5,035,351 A * 7/1991 Moran ..... 222/386.5

* cited by examiner

*Primary Examiner*—Joseph A. Kaufman
*Assistant Examiner*—John Fristoe
(74) *Attorney, Agent, or Firm*—Joe Nieh

(57) ABSTRACT

A pressurized piston pusher is disclosed that will extract viscous fluids from a container. The pressurized piston pusher operates with the seal to allow the rate of flow of the viscous fluid from the container to be predetermined and controlled economically and accurately. The pressurized piston pusher will also allow the forced ejection of the viscous fluid from the container.

12 Claims, 1 Drawing Sheet

PRESSURIZED PISTON PUSHER

BACKGROUND-FIELD OF INVENTION

The present invention relates to a pressurized piston pusher for extracting and controlling the rate of flow of viscous fluids from a container.

BACKGROUND-DESCRIPTION OF RELATED ART

Containers that enclose viscous fluids to be stored and transported must be leak-proof and yet must open easily for access to its contents. When the containers are opened for access to their contents, there is no control over the rate of the extraction of the viscous fluid from the containers. There is no economical and accurate method of presetting the rate of extraction of the viscous fluid from the containers.

SUMMARY OF THE INVENTION

The present invention is a pressurized piston pusher that will controls the rate of flow of viscous fluid from the container after opening. The present invention allows the rate of flow of the viscous fluid from the container to be predetermined and controlled economically and accurately.

DETAILED DESCRIPTION OF THE PREFERRED EMBODIMENT

Figure 1:
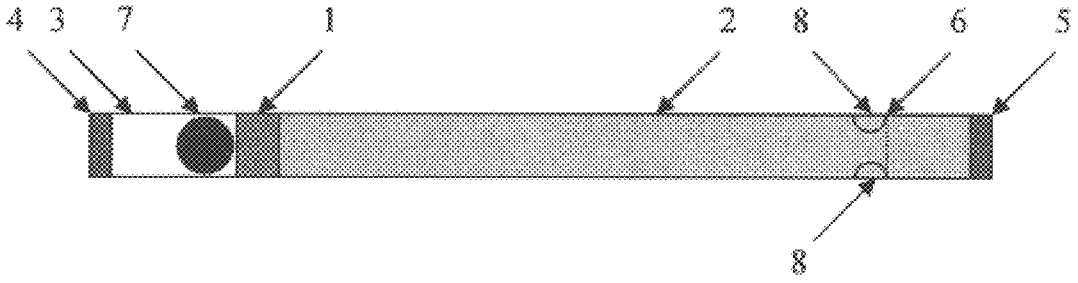
FIG. 1 shows the pressurized piston pusher 7 inserted in one end 4 of the container containing the viscous fluid 2 that can be opened at the predetermined location 6 near the other end 5 of the container.

FIG. 1 shows the preferred embodiment of the pressurized piston pusher 7. A pressurized piston pusher 7 is inserted in one end 4 of a long slender cylindrical container that can be opened at the predetermined location 6 near the other end 5 with the viscous fluid 2. The container is partially filled with the desired viscous fluid 2 such as grease, gel, or medications with high viscosity. The pressurized piston pusher 7 is inserted at one end 4 of the container enclosing the viscous fluid 2 separated from the viscous fluid 2 by a seal 1 of a high viscosity fluid that will not mix with or dissolve in the viscous fluid 2. A predetermined air enclosure 3 is maintained near the end 4 of the container separated from the viscous fluid 2 by the pressurized piston pusher 7 and the seal 1.

The container is sealed in an environment with above normal air pressure which will create a pressurized air enclosure 3. The viscous fluid 2 is incompressible. The air in the air chamber 3 will be pressurized to the same pressure as the pressurized environment it was sealed in. The pressurized piston pusher 7 and the seal 1 will maintain the separation of the air enclosure 3 and the viscous fluid 2. The container is sealed on both ends 4, 5 so that no leakage of the viscous fluid 2 is possible. The container can break open at predetermined location 6 in the viscous fluid 2 portion of the container by scoring the outside perimeter of the container at the predetermined location 6.

When the viscous fluid 2 is to be release from the container, it is broken open at the predetermined location 6 determined by the scorings on the container. Once the container is opened, the viscous fluid 2 will be forced out of the container by the air pressure in the air enclosure 3 acting against the pressurized piston pusher 7 which in turn acts against the seal 1 at a rate determined by the viscosity and the length of the seal 1. A higher viscosity and/or longer seal 1 will allow the viscous fluid 2 to flow out of the container after a predetermined delay and at a slow controlled speed. A lower viscosity and/or shorter seal 1 will allow the viscous fluid 2 to flow out of the container almost immediately and at a rapid speed. The amount of viscous fluid 2 to be release can be determined by breaking the end 5 of the container containing the viscous fluid 2 at predetermined location 6. The end 5 containing the viscous fluid 2 that breaks off from the container will retain the viscous fluid 2 within it since it is sealed on one end 5 and atmospheric air pressure will prevent the viscous fluid 2 contained within it from being released.

Figure 2:
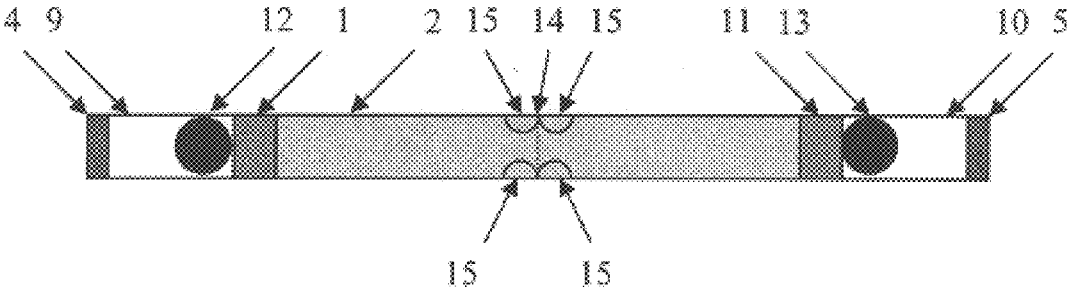
FIG. 2 shows the pressurized piston pushers 12, 13 inserted in both ends 4, 5 of the container that can be opened at the predetermined location near the center 14 of the container.

FIG. 2 shows another embodiment of the pressurized piston pusher 12, 13. A pressurized piston pusher 12, 13 is inserted in each end 4, 5 of a container that can be opened at a predetermined location near the center 14 of the container. The container is partially filled with the desired viscous fluid 2 such as grease, gel, or viscous medications. The two pressurized piston pushers 12, 13 are inserted at both ends 4, 5 of the container enclosing the viscous fluid 2. A predetermined air enclosure 9, 10 is maintained on both ends 4, 5 of the container separated from the viscous fluid 2 by the pressurized piston pushers 12, 13 and the seals 1, 11. The container is sealed on both ends 4, 5 so that no leakage of the viscous fluid 2 is possible. The container can break open at the predetermined location 14 at the scoring placed near the center of the container at the outside perimeter of the container.

The container is sealed in an environment with above normal air pressure which will create pressurized air enclosures 9, 10. The viscous fluid 2 is incompressible. The air in the air enclosures 9, 10 will be pressurized to the same pressure as the pressurized environment it was sealed in. Since there are air enclosures 9, 10 in both ends 4, 5 of the container, the viscous fluid 2 will maintain its position in the middle of the container. The pressurized piston pushers 12, 13 and the seals 1, 11 will maintain the separation of the air enclosure 9, 10 and the viscous fluid 2.

When the viscous fluid 2 is to be release from the container, the container may be broken open at the predetermined location near the center 14 of the container. Once the container is open, the air pressure in the air enclosure 9, 10 will force the viscous fluid 2 out of the container at a predetermined rate after a predetermined delay. The viscous fluid 2 will flow out of the container at a rate determined by the viscosity and the length of the seals 1, 11. A higher viscosity and/or longer seal 1, 11 will allow the viscous fluid 2 to flow out of the container after a predetermined delay and at a slow controlled speed. A lower viscosity and/or shorter seal 1, 11 will allow the viscous fluid 2 to flow out of the container almost immediately and at a rapid speed.

The container may have one or more protrusions 8, 15 in its interior surface near the predetermined location 6, 14 such that after the viscous fluid 2 is released from the container, the pressurized piston pusher 7, 12, 13 is retained in the container and not ejected. The container may also have one or more indentations from its outside walls which will create the protrusions 8, 15 in its interior surface to achieve the same result.

What is claimed is:

1. A pressurized piston pusher comprising:

a housing with scoring at one or more predetermined locations and with two ends that are sealed to prevent leakage of viscous fluids contained within it and maintains a pressurized air enclosure;

a seal comprising of a viscous substance inserted in the housing separating the viscous fluid from the air thereby creating an pressurized air enclosure;

a pressurized piston pusher comprising of a piston with a cross-sectional profile that is approximately that of the internal cross-sectional profile of the housing;

wherein the pressurized air enclosure will urge the pressurized piston pusher to force the viscous fluid out of the container when the container is opened at the scoring at one or more predetermined locations.

2. A pressurized piston pusher as in claim 1, wherein two pressurized piston pushers are inserted at either end of the housing separating the fluid contained in the housing from pressurized air enclosures at either end of the housing.

3. A pressurized piston pusher as in claim 1, wherein the housing has an internal and an external surface and wherein the internal surface has one or more protrusion near the scoring at one or more predetermined locations to retain the pressurized piston pusher after the viscous fluids are forced out of the housing.

4. A pressurized piston pusher as in claim 2, wherein the housing has an internal and an external surface and wherein the internal surface has one or more protrusion near the scoring at one or more predetermined locations to retain the pressurized piston pusher after the viscous fluids are forced out of the housing.

5. A pressurized piston pusher as in claim 1, wherein the housing has an internal and an external surface and wherein the external surface has one or more indentation that deforms the internal surface near the scoring at one or more predetermined locations to retain the pressurized piston pusher after the viscous fluids are forced out of the housing.

6. A pressurized piston pusher as in claim 2, wherein the housing has an internal and an external surface and wherein the external surface has one or more indentation that deforms the internal surface near the scoring at one or more predetermined locations to retain the pressurized piston pusher after the viscous fluids are forced out of the housing.

7. A pressurized piston pusher comprising:

a housing with scoring at one or more predetermined locations and with two ends that are sealed to prevent leakage of viscous fluids contained within it and maintains a pressurized air enclosure;

a seal comprising of a viscous substance inserted in the housing separating the viscous fluid from the air thereby creating an pressurized air enclosure;

a pressurized piston pusher comprising of a piston made with a rigid material with a cross-sectional profile that is slightly smaller than that of the internal cross-sectional profile of the housing;

wherein the pressurized air enclosure will urge the pressurized piston pusher to force the viscous fluid out of the container when the container is opened at the scoring at one or more predetermined locations.

8. A pressurized piston pusher as in claim 7, wherein two pressurized piston pushers are inserted at either end of the housing separating the fluid contained in the housing from pressurized air enclosures at either end of the housing.

9. A pressurized piston pusher as in claim 7, wherein the housing has an internal and an external surface and wherein the internal surface has one or more protrusion near the scoring at one or more predetermined locations to retain the pressurized piston pusher after the viscous fluids are forced out of the housing.

10. A pressurized piston pusher as in claim 8, wherein the housing has an internal and an external surface and wherein the internal surface has one or more protrusion near the scoring at one or more predetermined locations to retain the pressurized piston pusher after the viscous fluids are forced out of the housing.

11. A pressurized piston pusher as in claim 7, wherein the housing has an internal and an external surface and wherein the external surface has one or more indentation that deforms the internal surface near the scoring at one or more predetermined locations to retain the pressurized piston pusher after the viscous fluids are forced out of the housing.

12. A pressurized piston pusher as in claim 8, wherein the housing has an internal and an external surface and wherein the external surface has one or more indentation that deforms the internal surface near the scoring at one or more predetermined locations to retain the pressurized piston pusher after the viscous fluids are forced out of the housing.

* * * * *